United States Patent [19]

Matsumoto

[11] 4,456,388

[45] Jun. 26, 1984

[54] WATCH CASE STRUCTURE

[75] Inventor: Masataka Matsumoto, Tokyo, Japan

[73] Assignee: Citizen Watch Company Limited, Tokyo, Japan

[21] Appl. No.: 260,501

[22] Filed: May 4, 1981

Related U.S. Application Data

[62] Division of Ser. No. 32,849, Apr. 24, 1979, abandoned.

[30] Foreign Application Priority Data

| | | | |
|---|---|---|---|
| Apr. 27, 1978 | [JP] | Japan | 53-50593 |
| Aug. 2, 1978 | [JP] | Japan | 53-93638 |
| Aug. 28, 1978 | [JP] | Japan | 53-104587 |
| Sep. 14, 1978 | [JP] | Japan | 53-113391 |
| Sep. 21, 1978 | [JP] | Japan | 53-115150 |
| Sep. 21, 1978 | [JP] | Japan | 53-115151 |
| Nov. 9, 1978 | [JP] | Japan | 53-138219 |

[51] Int. Cl.[3] ..... G04B 37/08

[52] U.S. Cl. ..... 368/294

[58] Field of Search ..... 368/276, 287, 291, 294–296

[56] References Cited

U.S. PATENT DOCUMENTS

| | | | |
|---|---|---|---|
| 3,950,937 | 4/1976 | Fujimori | 368/296 X |
| 4,110,970 | 9/1978 | Fuwazawa et al. | 368/291 |
| 4,132,062 | 1/1979 | Fujimori | 368/294 X |
| 4,234,948 | 1/1980 | Maekawa et al. | 368/291 |

*Primary Examiner*—Vit W. Miska

*Attorney, Agent, or Firm*—Jordan and Hamburg

[57] ABSTRACT

A watch case structure comprising a watchglass member, a bezel member, a case band member and a back cover member interconnected to define said watch case structure. One of said members includes an inclined surface and a substantially vertical wall. An annular groove means is formed in another one of said members and includes an inclined surface. A synthetic resin gasket is disposed in said annular groove means of said another one of said members and includes an inclined guiding surface and an inclined engaging surface engaging with the inclined surface of said annular groove means. The one of said members is press fitted to said synthetic resin gasket, whereby said synthetic resin gasket is made to fill a space formed by the vertical wall of said one of said members and said annular groove means and at least a portion of said synthetic resin gasket is compressed between the inclined surface of said one of said members and the inclined surface of said annular groove means to thereby fixedly retain said one of said members in place.

5 Claims, 26 Drawing Figures

WATCH CASE STRUCTURE

This is a division, of application Ser. No. 32,849, filed Apr. 24, 1979, now abandoned.

BACKGROUND OF THE INVENTION

This invention relates to watch cases, and more particularly, to a fixing structure for fixedly retaining a watchglass, a bezel, or a back cover within such a watch case.

A conventional watch case has a fixing structure for fixedly retaining a watchglass, a bezel or a back cover in the bezel or a case band, respectively. The fixing structure usually employs a synthetic resin gasket, which is compressed between the outer circumference of, for example, a watchglass and the inner circumference of, for example, a case band. In this case, the watchglass and the gasket are fixedly retained against the axial movement due to the frictional force existing therebetween, and the case band and the gasket are fixed against the axial movement due to the frictional force existing therebetween. Since the fixing force between the gasket and the case band is greater than that between the watchglass and the gasket, the gasket must be subjected to a large compression force in the direction of its diameter in order to provide a sufficient fixing force and water-tight seal over a long period of time. However, when a large amount of compression is applied, the gasket protrudes excessively in the axial direction at the time that it is press fitted about the outer circumference of the watchglass. The same problems arise in the fixing structure between the watchglass and the bezel, between the bezel and the case band or between the back cover and the case band. It is therefore not possible to obtain reliable fixing force and waterproofness. In order to solve these problems, it has been proposed to increase the height of the watchglass, bezel, case band or the back cover so as to increase the fixing force between the adjacent members. As a result, it is extremely difficult to provide a watch case having a reduced thickness.

It is, therefore, an object of the present invention to provide a fixing structure that makes it possible to minimize watch case thickness.

It is another object of the present invention to provide a watch case for water-proofing and fixedly securing a watchglass, a bezel or a back cover.

DESCRIPTION OF THE PREFERRED EMBODIMENTS

Figure 1:
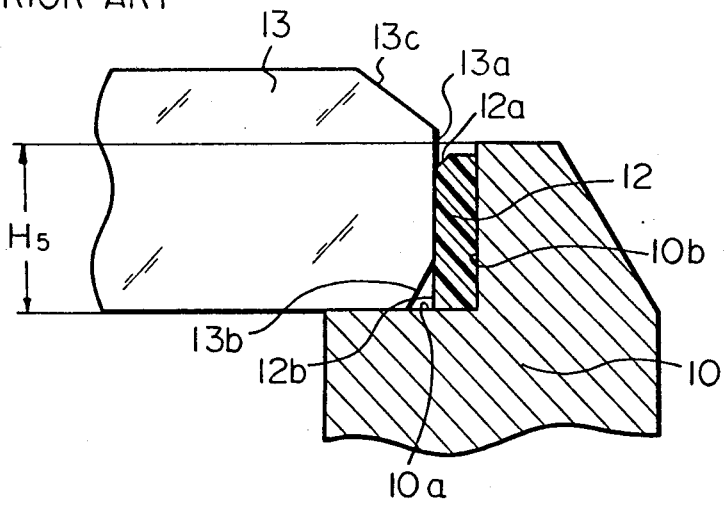
Fig. 1 PRIOR ART
FIG. 1 is a cross-sectional view of one example of a watch case according to the prior art.

Referring now to FIG. 1, there is shown one example of a prior art watch case. In FIG. 1, the watch case is shown as comprising a case band 10, a synthetic resin gasket 12, and a watchglass 13. The upper part of the inner wall of the case band 10 includes a stepped portion 10*a* for seating the synthetic resin gasket 12 and the watchglass 13, an axial wall 10*b* of the case band 10 defining a substantially vertical surface. The synthetic resin gasket 12 has an I-shaped cross-section including an inclined guiding surface 12*a* along the upper edge of its inner peripheral surface to facilitate the insertion of the watchglass 13. The peripheral surface of watchglass 13 includes a substantially vertical wall 13*a* and an inclined guiding surface 13*b* provided below the wall 13*a* to guide the watchglass into the synthetic resin gasket 12 when the former is press-fitted into the latter. The synthetic resin gasket 12 is disposed adjacent the axial wall 10*b* of the case band 10 and is compressed between the wall 13*a* of the watchglass 13 and the axial wall 10*b* of the case band 10 thereby fixedly securing the watchglass 13 on the stepped portion 10*a* of the case band 10 owing to the frictional force resulting from the compressed synthetic resin gasket 12. It has been learned from experience that the height of the synthetic resin gasket 12 in the above structure must be at least 1.2 mm in order to maintain a sufficient fixing force and water-tight seal between the case band 10 and watchglass 13; a height of less than 1.2 mm allows the water tight seal and fixing force to weaken so that it is difficult to commercialize the timepiece. In other words when the height of the watch glass is reduced it becomes necessary to correspondingly increase the compressibility, an alternative which makes it more difficult to install the watchglass.

The total thickness of the structure described above, resulting mainly from the depth of the stepped portion 10*a*, the height of the synthetic resin gasket 12 and the thickness of the watchglass 13, must be reduced in order to provide thinner, more compact watch cases, especially in view of the great advancements in electronic technology which have made it possible to reduce the thickness of electronic timepiece movements to as little as 1 mm.

Figure 2:
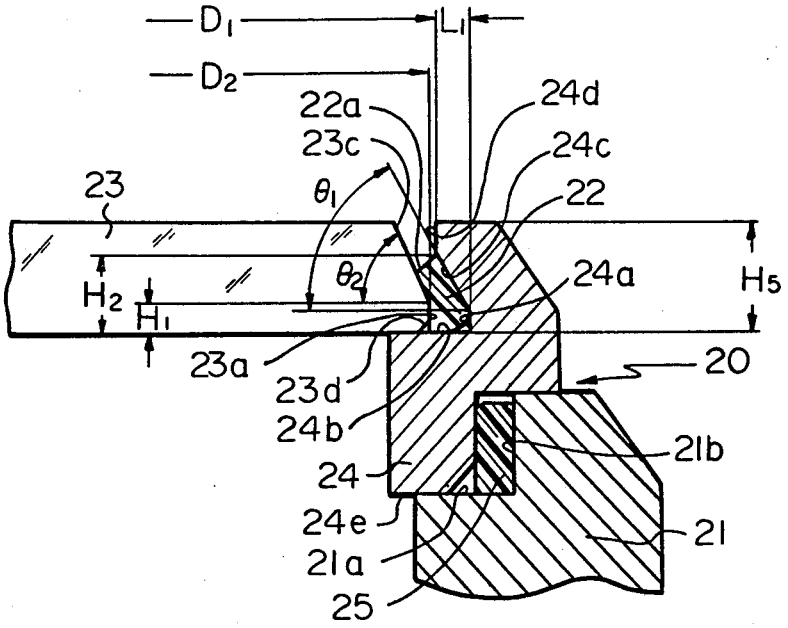
FIG. 2 is a cross-sectional view of one preferred embodiment of a watch case according to the present invention.
Figure 3:
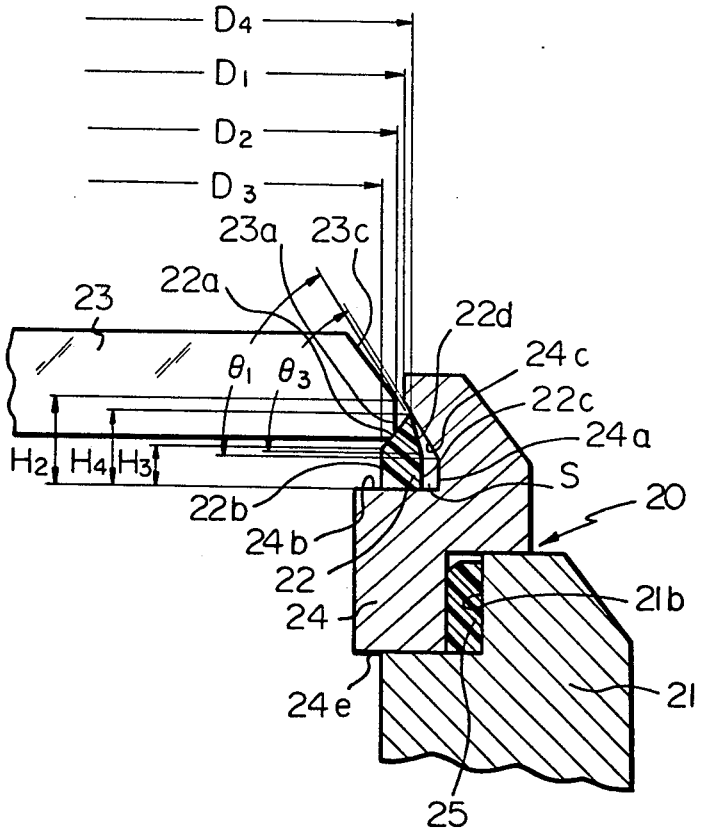
FIG. 3 is a cross-sectional view showing the installation of the watchglass of FIG. 2.

Referring now to FIGS. 2 and 3, there is shown a preferred embodiment of a watch case according to the present invention. In FIGS. 2 and 3, reference numeral 20 denotes a watchglass fixing member composed of a case band 21 and a bezel 24 having its bottom wall 24e engaging a shoulder portion 21a of the case band 21 which has an axial wall 21b. A synthetic resin gasket 22 is compressed between a watchglass 23 and the bezel 24. A synthetic resin gasket 25 is compressed between the bezel 24 and the case band 21. The upper part of the inner wall of the bezel 24 includes an inwardly facing annular groove 24a for accommodating a lower portion of the synthetic resin gasket 22, and a radially extending shoulder or stepped portion 24b for seating the watchglass 23 and a bottom surface of the gasket 22. The side surface of the annular groove 24a and the stepped portion 24b lying in the same horizontal plane and hence defining the same surface, with the upper surface of the annular groove 24a having the form of an inclined surface 24c, which defines an angle $\theta_1$ with the horizontal, so as to provide a sufficient area of contact between the synthetic resin gasket 22 and the bezel 24 while at the same time allowing the synthetic resin gasket 22 to be suitably compressed. The depth $L_1$ of annular groove 24a is such as will allow outward protrusion of the compressed portion of synthetic resin gasket 22 when the watchglass 23 is press-fitted into the bezel 24. The inside diameter $D_1$ of the inner axial wall 24d of stepped portion 24b is designed to be slightly greater than the outside diameter $D_2$ of the watchglass 23 in order to guide the watchglass 23 at the time of assembly.

The peripheral surface of watchglass 23 includes a substantially vertical wall 23a and an inclined surface 23c formed above the vertical wall 23a and defining an angle $\theta_2$ with respect to the horizontal to correspond to the angle $\theta_1$ of the inclined surface 24c. The angle $\theta_2$ is preferably selected to be greater than the angle $\theta_1$ so as to allow effective compression of the synthetic resin gasket 22. The bottom edge of the peripheral surface of watchglass 23 includes a slightly chamfered surface 23d on the order of, for instance, 50 microns. With the surface on which the watchglass 23 is seated serving as a reference point, the height $H_1$ of the intersection between the vertical wall 23a and the inclined surface 23c of the watchglass 23 is selected to be less than the height $H_2$ of the intersection between the inclined surface 24c and the inner axial wall 24d of the bezel 24.

As shown in FIG. 3, the inner peripheral surface of the synthetic resin gasket 22 includes a substantially vertical inner wall 22b, the upper part of the inner wall 22b having an inclined guiding surface 22a to facilitate the installation of the watchglass 23. The inside diameter $D_3$ defined by the inner wall 22b of the synthetic resin gasket 22 is set to be slightly less than the outside diameter $D_2$ of the watchglass 23 so that the watchglass 23 will slide along the inclined guiding surface 22a and for forced into the lower portion of the inner wall 22b of the gasket 22 when the watchglass 23 is press-fitted into the synthetic resin gasket 22. With the surface on which the watchglass 23 is seated again serving as the reference point, the height $H_3$ of the intersection between the inner vertical wall 22b and the inclined guiding surface 22a of the synthetic resin gasket 22 is designed to be greater than $H_1$ in order to enhance the watchglass fixing force but less than $H_2$ in order to prevent the synthetic resin gasket 22 from being pulled inward during the press-fitting of the watchglass 23. The outer peripheral surface of the synthetic resin gasket 22 includes a substantially vertical outer wall 22c the upper part of which has an inclined engaging surface 22d which allows the gasket to be firmly fixed within the annular groove 24a, the surface 22d defining an angle $\theta_3$ with the horizontal that is greater than the angle $\theta_1$ of the inclined surface 24c of the bezel 24. Measuring again from the surface on which the watchglass 23 is seated, the height $H_4$ of the intersection between the inclined guiding surface 22a and the inclined engaging surface 22d of the synthetic resin gasket 22 is less than the height $H_2$, while the point of intersection also defines a diameter $D_4$ which is slightly larger than the diameter $D_1$. The synthetic resin gasket 22 is strongly compressed in the space formed by the annular groove 24a of the bezel 24 and the vertical wall 23a and inclined surface 23c of the watchglass 23. As a result, the gasket fills every corner of the space owing to its plasticity and hence provides a watertight seal between the watchglass 23 and bezel 24 while maintaining a sufficient fixing force therebetween.

The watchglass 23 is fixedly secured in the following manner. The synthetic resin gasket 22 is first disposed in the annular groove 24a of bezel 24, after which the watchglass 23 is placed upon the inclined guiding surface 22a of the synthetic resin gasket 22. At this time the intersection between the inclined guiding surface 22a and inclined engaging surface 22d is in contact with the inclined surface 24c of the annular groove 24a and the lower surface of the watchglass 23 is located at a height lower than $H_2$. A gap S is formed in the interior of the annular groove 24a. Next, the watchglass 23 is pressed downward by means of a jig or other suitable means until it abuts the stepped portion 24b. During this press-fitting step the watchglass 23 slides downwardly along the inclined guiding surface 22a of the gasket 22 causing the synthetic resin gasket 22 to expand outwardly in the diametric direction until the gasket 22 gradually creeps into the gap S and fills the annular groove 24a. When the watchglass 23 has reached the stepped portion 24b the synthetic resin gasket 22 is compressed under a maximum force between the inclined surface 24c of the bezel 24 and the inclined surface 23c of the watchglass 23, thereby fixedly securing the watchglass 23 as shown in FIG. 2. In addition, the fact that the watchglass 23 has been forced into the lower portion of the inner peripheral surface of the synthetic resin gasket 22 provides a reliable waterproof condition.

The fixing structure explained above enables a sufficient fixing force and watertightness to be obtained even if the depth $H_5$ of the fixing portion of bezel 24 is in a range of 0.6 mm. This is an epoch-making accomplishment in view of the fact that the depth $H_5$ of the prior-art fixing portion is 1.2 mm at minimum. Whereas the prior-art structure does not permit the use of a watchglass having a thickness of less than 1.2 mm, it is possible with the present invention to reduce watchglass thickness to 0.4 mm and still maintain sufficient fixing force and watertightness, thus fully meeting the demand for thinner, more compact watch cases. The present invention is also advantageous in that the inclined surface 24c formed in the upper part of the annular groove 24a facilitates the installation of the synthetic resin gasket 22 into the annular groove 24*a* and prolongs tool lifetime during machining.

Figure 4:
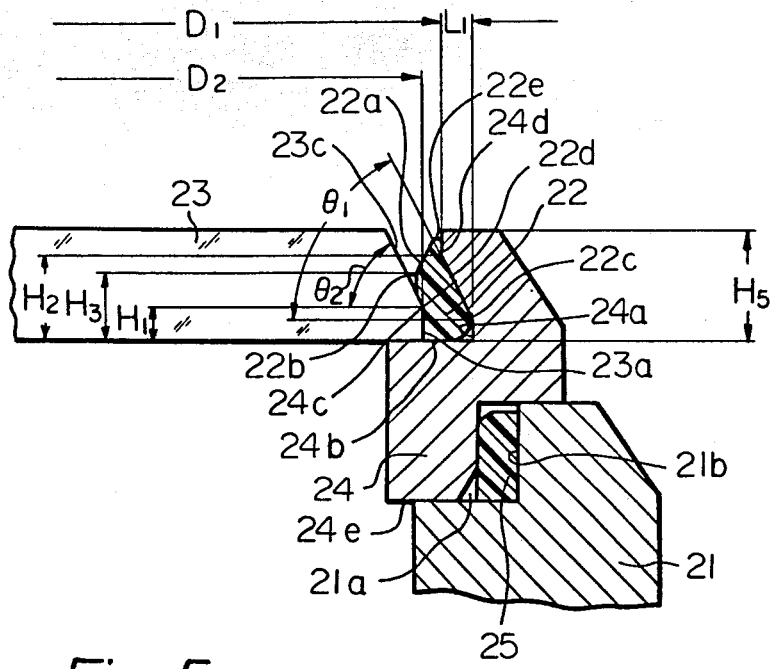
FIGS. 4 and 5 are cross sectional views of another modification of the watch case shown in FIGS. 2 and 3.
Figure 5:
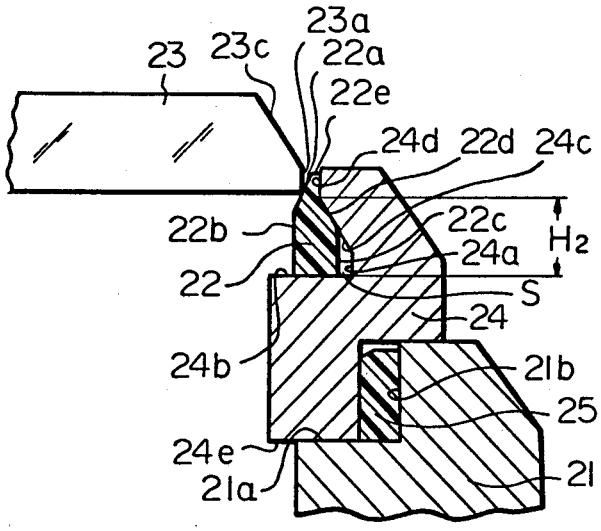

FIGS. 4 and 5 show a modification of the watch case shown in FIGS. 2 and 3, with like parts bearing the same reference numerals as used in FIGS. 2 and 3. In the modification shown in FIGS. 4 and 5, the gasket 22 has an upward projection 22*e* of which outer surface engages the opposing axial wall 24*a* of the bezel 24 to further enhance the waterproofness between the gasket 22 and the bezel 24. Other structures of the watch case are identical to those shown in FIGS. 2 and 3, and accordingly, a detailed description of the same is herein omitted for the sake of simplicity of description.

Figure 6:
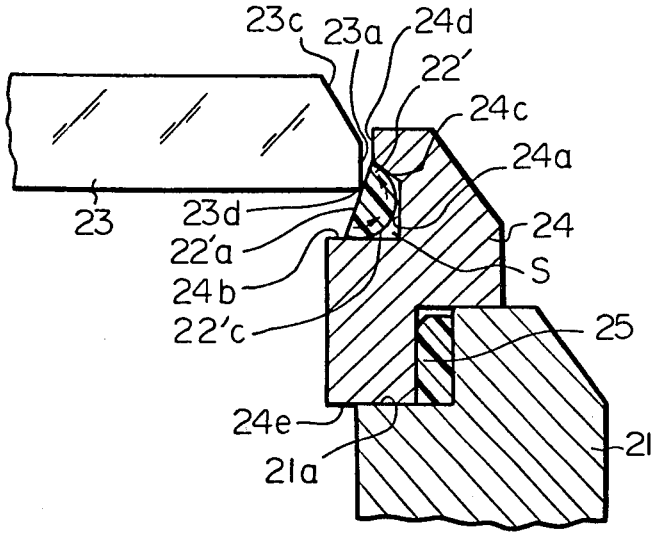
FIGS. 6 and 7 are cross sectional views of another modification of the watch case shown in FIGS. 2 and 3.
Figure 7:
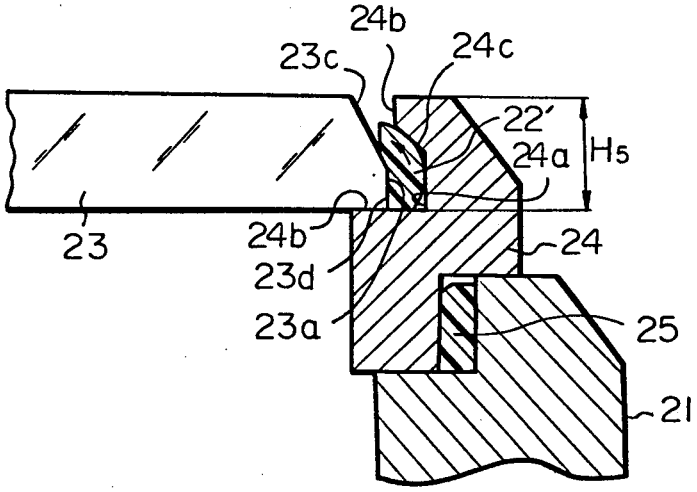

FIGS. 6 and 7 show another modification of the watch case shown in FIGS. 2 and 3, with like parts bearing the same reference numerals as those used in FIGS. 2 and 3. In the modification of FIGS. 6 and 7, a synthetic resin gasket 22′ includes an inner peripheral surface which defines an inclined inner guiding surface 22′*a*, and an outer peripheral surface which defines a curved outer wall 22′*c* that is extended until it intersects the inclined inner guiding surface 22′*a*, the gasket thus having a D-shaped cross-section. Other structures are idential to those of FIGS. 2 and 3 and, therefore, a detailed description of the same is omitted.

The assembly of the watch case comprising the watchglass 23, synthetic resin gasket 22′ and bezel 24 proceeds as follows. First, the synthetic resin gasket 22′ is placed upon the stepped portion 24*b* of bezel 24 in such a manner that the upper portion of the outer curved wall 22′*c* of the gasket 22 comes into contact with the inclined surface 24*c* defined by the upper surface of annular groove 24*a* of bezel 24. At this time a gap S is formed in the interior of the annular groove 24*a* between the gasket 22 and bezel 24. The gap S prevents the synthetic resin gasket 22 from being pulled inward when the waterglass 23 is press-fitted into the gasket 22. Next, the watchglass 23 is disposed so as to engage its lower exterior edge, namely the chamfered surface 23*d*, with the inclined inner guiding surface 22′*a* of the gasket 22′, as is shown in FIG. 6. Applying pressure to the watchglass 23 while maintaining these conditions allows the watchglass 23 to be guided downward along the inclined inner guiding surface 22′*a* so that it approaches the stepped portion 24*b* while the synthetic resin gasket 22′ is urged into the annular groove 24*a*. Pressing the watchglass 23 in this fashion causes the synthetic resin gasket 22′ to expand into the annular groove 24*a* until the resin gasket 22′ gradually creeps into gap S and fills the annular groove 24*a* owing to the plasticity of the resin. When the lower surface of the watchglass 23 has reached the stepped portion 24*b* of bezel 24 the synthetic resin gasket 22′ is compressively sandwiched under maximum force by the inclined surface 24*c* of the annular groove 24*a* as well as the inclined surface 23*c* and vertical wall 23*a* of the watchglass 23 thereby to fixedly secure the watchglass 23 by means of a counterforce resulting from compression. This condition is depicted in FIG. 7. A portion of the gasket 22′ is also pushed outward by the inclined surface 23*c* of the watchglass 23. It should be noted here that the chamfered surface 23*d* prevents the gasket 22′ from being damaged during the press-fitting of the watchglass 23.

In the modification shown in FIGS. 6 and 7, the synthetic resin gasket 22′ sandwiched between the inclined surface 23*c* of the watchglass 23 and the inclined surface 24*c* of the bezel 24 upon completion of the assembly serves to bias the watchglass 23 and bezel 24 in mutually opposing directions so that the watchglass 23 is reliably held in place owing to the component of the force in parallel with the stepped portion 24*b*, which component acts upon the inclined surface 23*c* of the watchglass 23. In addition, the inclined surfaces 23*c*, 24*c* increase the area of contact between the synthetic resin gasket 22′ and the watchglass 23 and bezel 24 on either side thereof, thereby enhancing watertightness. It is therefore possible with the structure of this type to reduce the depth $H_5$ of the stepped portion 24*b* to 0.6 mm and still maintain the fixing force and watertight seal. At the time of assembly, moreover, the rounded configuration of the curved outer wall 22′*c* allows the gasket 22′ to rotate easily in the direction of the arrows as shown in FIG. 6 so that there is even less danger of the gasket 22′ being pulled inward during the press-fitting step.

Figure 8:
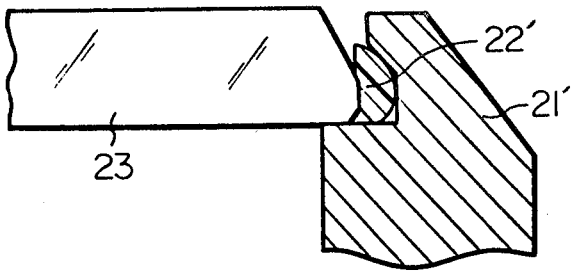
FIG. 8 is a cross sectional view of a modification of the watch case shown in FIGS. 6 and 7.

It is also possible for the watchglass 23 to be mounted directly in the case band 21′ as depicted in FIG. 8, in which the watchglass fixing member comprises the case band 21′.

Figure 9:
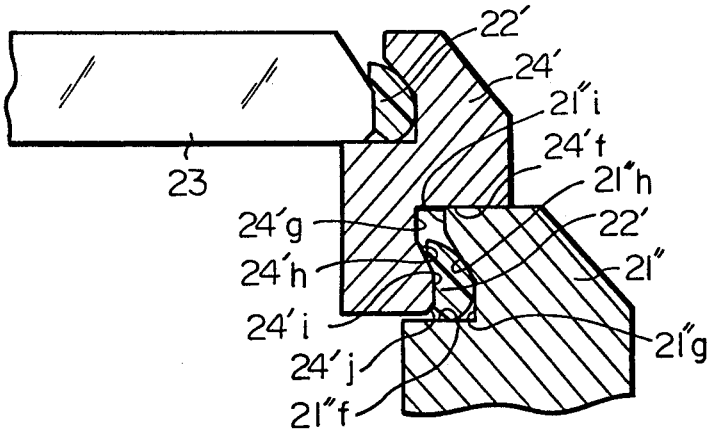
FIG. 9 is a cross sectional view of still another modification of the structure shown in FIGS. 6 and 7.

It should also be obvious that the bezel 24′ can be mounted in the case band 21″ through the intermediary of the synthetic resin gasket 22′, which arrangement is illustrated in FIG. 9. In this case the watchglass 23 of FIG. 7 can be considered as being replaced by bezel 24′ of FIG. 9, and the bezel 24′ of FIG. 7 as being replaced by case band 21″ of FIG. 9. In FIG. 9, the bezel 24′ has a stepped or radially outwardly extendial shoulder portion 24′*f*, an annular groove 24′*g* having an inclined surface 24′*h* extending to and continuous with a vertical wall 24′*i*, and a chamfered edge 24′*j*. Likewise, the case band 21″ has a stepped or radially inwardly extending shoulder portion 21″*f*, an annular groove 21″*g* facing the vertical wall 24′*i* of the bezel 24′, an inclined surface 21″*h*, and a vertical wall 21″*i* continuous with the inclined surface 21″*h*. During assembly, the synthetic resin gasket 22′ is disposed in the annular groove 21″*g* of the case band in a manner similar to that shown in FIG. 6. Thereafter, the watchglass 23 is press-fitted through the gasket 22′. In this instance, the vertical wall 24′*i* of the bezel 24′ is guided on the inclined surface of the gasket 22′, and the upper portion of the gasket 22′ is caused to engaged with the inclined surface 24′*h* of the bezel 24′. On the other hand, the outer curved wall of the gasket 22′ is compressed against the inclined surface 21″*h* of the case band 21″. In this manner, the bezel 24′ and the case band 21″ are fixedly retained to one another by the action of the gasket 22′, by which the waterproofness is provided.

Figure 10:
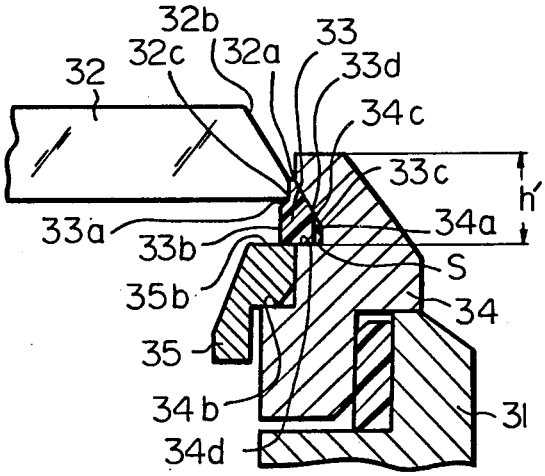
FIGS. 10 and 11 are cross sectional views of a further modification of the watch case shown in FIGS. 2 and 3.
Figure 11:
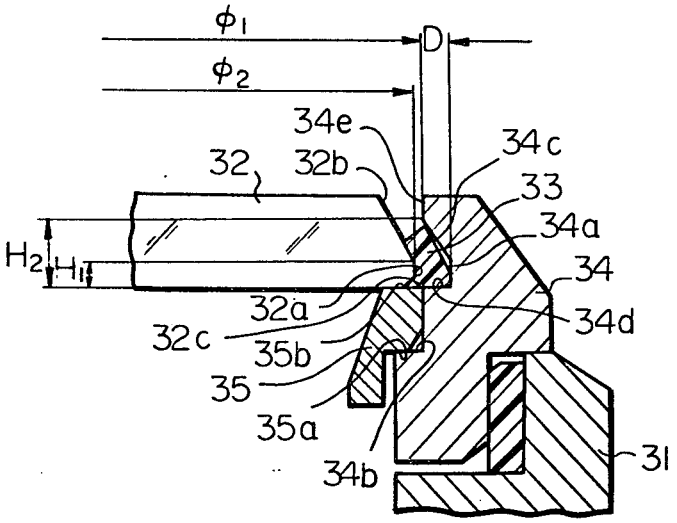

FIGS. 10 and 11 show another preferred embodiment of a watch case according to the present invention. FIG. 10 is a cross-sectional view showing a watchglass 32 prior to its insertion into a bezel 34 serving as a watchglass fixing member, and FIG. 11 is a cross-sectional view showing the watchglass 32 after it has been press-fitted into the bezel 34. In FIGS. 10 and 11, the upper part of the inner wall of bezel 34 includes an annular groove 34*a*, the lower part of the annular groove 34*a* having a stepped portion 34*b* upon which a bearing ring 35 is placed. The upper surface of groove 34*a* defines an inclined surface 34*c*, while the lower surface defines a seating surface 34*d* for seating the synthetic resin gasket 33. The depth D of annular groove 34*a* is such as will allow outward protrusion of the compressed portion of synthetic resin gasket 33 when the watchglass 32 is press-fitted into the bezel 34, while inside diameter $\phi_1$ of the vertical inner wall 34e of stepped portion 34b is designed to be slightly greater than the outside diameter $\phi_2$ of watchglass 32 in order to guide the watchglass 32 at the time of assembly.

The lower part of bearing ring 35 includes a seating surface 35a which is placed upon the stepped portion 34b of bezel 34, while the upper part of the bearing ring 35 includes a watchglass seating surface 35b for seating the lower surface of watchglass 32. The bearing ring 35 is designed such that its watchglass seating surface 35b lies in substantially the same plane as the seating surface 34d of annular groove 34a once the bearing ring 35 has been disposed in the bezel 34. It should be noted that a reinforcing ring member such as a backing ring or masking plate may serve as the bearing ring 35.

The peripheral surface of watchglass 32 includes a substantially vertical wall 32a having an inclined surface 32b appoximately in parallel with the inclined surface 34c defined by the upper surface of the annular groove 34a, the inclined surface 32b being formed along the upper edge of the vertical wall 32a. The watchglass 32 also has a chamfered surface 32c along the lower edge of the vertical wall 32a. The watchglass 32 is designed such that the outside diameter $\phi_2$ thereof is slightly smaller than the inside diameter $\phi_1$ defined by the vertical inner wall 34e of stepped portion 34b so that the synthetic resin gasket 33 will be pressed in the diametric direction. With the watchglass seating surface 35b serving as a reference point, the height $H_1$ of the intersection between the wall 32a and the inclined surface 32b of the watchglass 32 is designed to be less than the height $H_2$ of the intersection between the inclined surface 34c and the vertical inner wall 34e of the bezel 34.

The inner peripheral surface of the synthetic resin gasket 33 includes a substantially vertical inner wall 33b, the upper part of the inner wall 33b having an inclined guiding surface 33a to facilitate the installation of the watchglass 32, and the outer peripheral surface of the gasket 33 includes a substantially vertical outer wall 33c the upper part of which has an inclined engaging surface 33d.

The assembly of the structure comprising the watchglass 32, synthetic resin gasket 33 and bezel 34 proceeds as follows. Once the bearing ring 35 has been disposed in the bezel 34, the synthetic resin gasket 33 is placed upon the seating surface 34d of annular groove 34a in such a manner that the upper portion of the inclined engaging surface 33d of the gasket 33 comes into contact with the inclined surface 34c defined by the upper surface of the annular groove 34a. At this time a gap S is formed in the interior of the annular groove 34a between the gasket 33 and glass bezel 34, as is shown in FIG. 10. The gap S prevents the synthetic resin gasket 33 from being pulled inward when the watchglass 32 is press-fitted into the gasket 33. Next, the watchglass 32 is disposed so as to engage its lower exterior edge, namely the chamfered surface 32c, with the inclined inner guiding surface 33a of the gasket 33, as is shown in FIG. 10. Applying pressure to the watchglass 32 while maintaining these conditions allows the watchglass 32 to be guided downward along the inner guiding surface 33a so that it approaches the bearing ring 35 while the synthetic resin gasket 33 is urged into the annular groove 34a. Press-fitting the watchglass 32 in this fashion causes the synthetic resin gasket 33 to expand into the annular groove 34a until the resin gradually creeps into the gap S and fills the annular groove 34a owing to the plasticity of the resin. When the lower surface of the watchglass 32 has reached the watchglass seating surface 35b the synthetic resin gasket 33 is compressively sandwiched under maximum force between the inclined surface 34c of annular groove 34a and the inclined surface 32b of watchglass 32 thereby to fixedly secure the watchglass by means of a counterforce resulting from compression. This condition is depicted in FIG. 11. It should be noted here that the chamfered surface 32c prevents the gasket 33 from being damaged during the press-fitting of the watchglass.

In accordance with the embodiment shown in FIGS. 10 and 11 the synthetic resin gasket 33 sancwiched between the inclined surface 32b of the watchglass 32 and the inclined surface 34c of the bezel 34 upon completion of the assembly serves to bias the watchglass and bezel in mutually opposing directions so that the watchglass is reliably held in place owing to the component of the force in parallel with the seating surface 35b, which component acts upon the inclined surface 32b of the watchglass 32. In addition, the inclined surfaces 32b, 34c increase the area of contact between the synthetic resin gasket 33 and the watchglass 32 and bezel 34 on either side thereof, thereby enhancing watertightness. It is therefore possible with the structure of this type to reduce the depth h' of the watchglass seating surface 35b to 0.6 mm and still maintain the fixing force and watertight seal.

Figure 12:
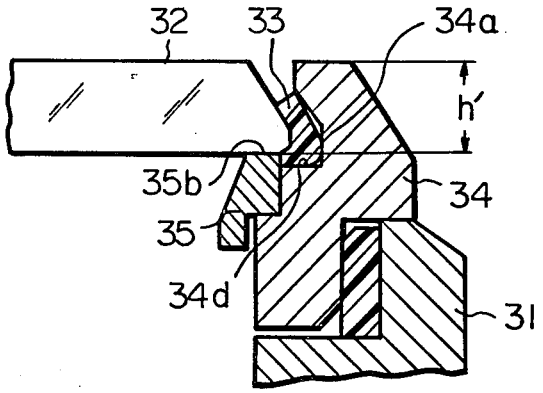
FIG. 12 is a cross sectional view of a modification of the structure shown in FIGS. 10 and 11.

FIG. 12 illustrates a modification of the embodiment shown in FIGS. 10 and 11 in which the watchglass seating surface 35b is located at a slightly higher level than the gasket seating surface 34d to prevent the gasket 33 from escaping from the annular groove 34a. The actions and effects of this modifications are exactly the same as those described above with reference to FIGS. 10 and 11.

Figure 13:
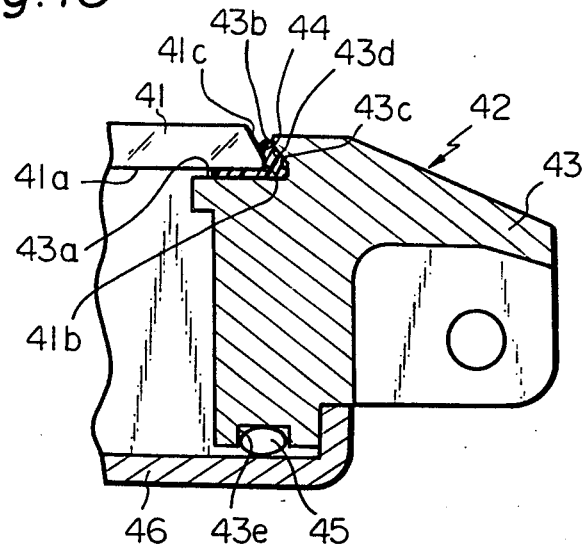
FIG. 13 is a cross sectional view of another preferred embodiment of a watch case according to the present invention.
Figure 14:
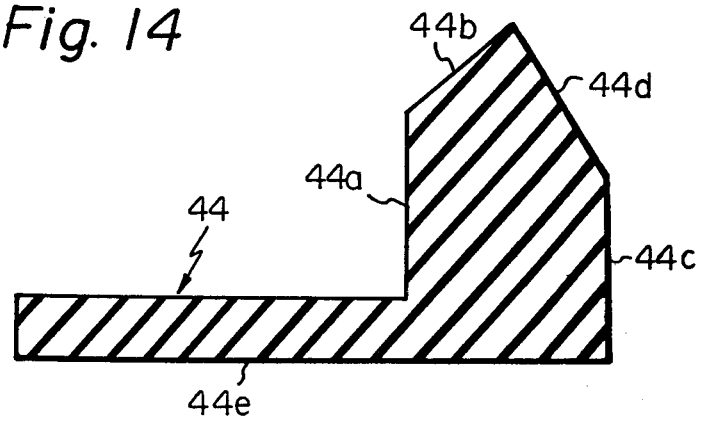
FIG. 14 is an enlarged cross sectional view of a synthetic resin gasket shown in FIG. 13.

FIG. 13 shows another preferred embodiment of a watch case according to the present invention. In this embodiment, the watch case is suited for an electronic timepiece having a liquid crystal display device to provide a display of time information in a digital form. In this case, a watchglass 41 serves as a masking plate for the liquid crystal display device (not shown) and has its bottom surface formed with a printed layer 41a having a desired printed pattern. The watchglass 41 also has a vertical wall 41b and an inclined guiding surface 41c. A watchglass fixing member 42 comprises a case band 43. The upper part of the inner wall of the case band 43 includes a stepped portion 43a for seating a synthetic resin gasket 44, an axial wall 43b of the case band 43 defining a substantially vertical surface. The case band 43 also has an inwardly facing annular groove 43c, which has an inclined surface 43d. As best shown in FIG. 14, the gasket 44 has a substantially vertical inner wall 44a, the upper part of the inner wall 44a having a inclined guiding surface 44b to facilitate the installation of the watchglass 41 into the gasket 44. The outer circumferential surface of the gasket 44 includes a substantially vertical outer wall 44c the upper part of which includes an inclined engaging surface 44d which allows the gasket 44 to be firmly fixed within the annular groove 43c. The gasket 44 also has a radially extending flat seating portion 44e, which is adapted to be interposed between the bottom wall of the watchglass 41 and the stepped portion 43a of the case band 43, to prevent the printed layer 41a of the watchglass 41 from contacting the stepped portion 43a for thereby preventing the printed layer 41a from being damaged. The case band 43 has its bottom surface formed with an annular recess 43*e* to accommodate therein a sealing ring 45. The sealing ring 45 is compressed by a back cover 46 fitted to a lower portion of the case band 43, to provide a waterproofness.

Figure 15:
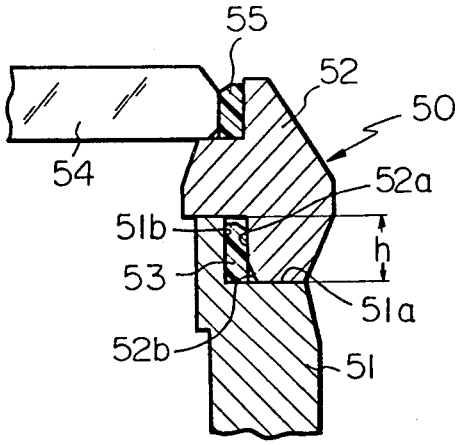
Fig. 15 PRIOR ART
FIG. 15 is a cross sectional view of another example of a prior art watch case.

FIG. 15 shows another example of a prior art watch case. The watch case comprises a watchglass 54, a watchglass fixing member 50 composed of a bezel 52 and a case band 51, a synthetic resin gasket 53 for fixedly securing the bezel 52, and a synthetic resin gasket 55 for fixedly securing the watchglass 54. More specifically, the upper part of the outer wall of case band 51 includes a stepped portion 51*a* for seating the synthetic resin gasket 53 and the bezel 52, the vertical wall 51*b* of stepped portion 51*a* defining a substantially vertical surface. The lower edge of the inner peripheral surface of bezel 52 includes an inner wall 52*a* in parallel with the vertical wall 51*b* of the stepped portion 51, and an inclined guiding surface 52*b* provided below the wall 52*a* to guide the bezel 52 over the outside of the synthetic resin gasket 53 when the former is pressfitted over the latter. The synthetic resin gasket 53 is placed on the stepped portion 51*a* of the case band 51 adjacent the wall 51*b* and, when the bezel 52 is fitted on the stepped portion 51*a*, is compressed from its inner and outer peripheral surfaces between the wall 51*b* of the case band 51 and the inner wall 52*a* of the bezel 52, thereby fixedly securing the bezel 52 on the stepped portion 51*a* of the case band 51 owing to the frictional force resulting from the compressed synthetic resin gasket 53. It should also be noted that the watchglass 54 is mounted in bezel 52 in the same manner. With this structure the height h of the synthetic resin gasket 53 must be a least 1.2 mm in order to maintain a reliable fixing force and watertight seal between the case band 51 and bezel 52; a height of less than 1.2 mm allows the watertight seal and fixing force to weaken so that it is difficult to commercialize the timepiece. It is therefore necessary in the conventional structure that the depth h of the vertical wall 51*b*, as shown in FIG. 15, be a minimum of 1.2 mm.

However, as modern mechanical movements now possess a thickness of between 2 and 3 mm and electronic movements a thickness of between 3 and 4 mm, there is an increasing need to produce ever thinner and more compact watch cases as well. The prior-art construction has not been able to meet this need for the reasons described above.

Figure 16:
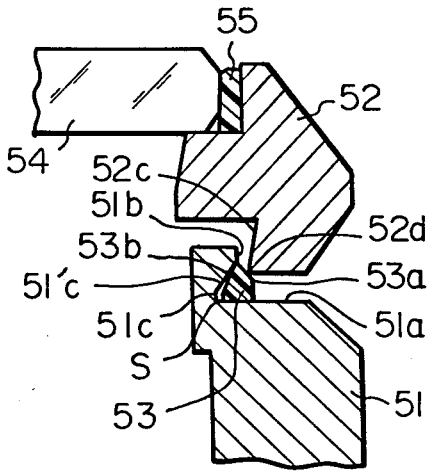
FIGS. 16 and 17 are cross sectional views of another preferred embodiment of a watch case according to the present invention.
Figure 17:
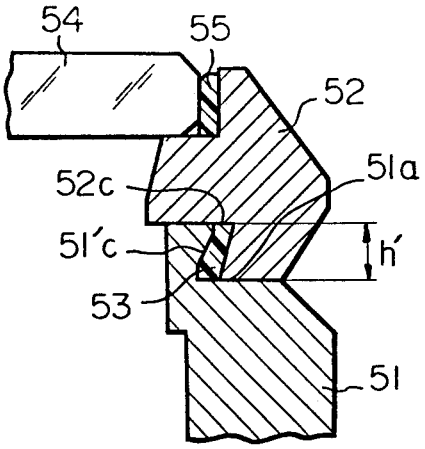

FIGS. 16 and 17 show another preferred embodiment of a watch case according to the present invention which overcomes the drawbacks encountered in the prior art watch case shown in FIG. 15, with like or corresponding component parts bearing the same reference numerals as those used in FIG. 15. Specifically, FIG. 16 is a cross-sectional view showing a bezel 52 prior to its being fixed to a case band 51, and FIG. 17 is a cross-sectional view showing the bezel after it has been fixed to the case band.

Referring now to FIGS. 16 and 17, the outer wall 51*b* of case band 51 includes an annular groove 51*c* the upper surface of which defines an inclined surface 51*c*, the lower surface of the annular groove 51*c* being formed in the same plane as a stepped portion 51*a*. A synthetic resin gasket 53 includes an outer peripheral surface the upper portion of which has an inclined outer guiding surface 53*a*, and an inner peripheral surface the upper portion of which has an inclined inner surface 53*b*. The inner periphery of that portion of bezel 52 that is to be fitted over case band 51 includes an inclined surface 52*c* approximately in parallel with the inclined surface 51'*c* defined by the upper surface of the annular groove 51*c*. The bezel 52 also has a chamfered surface 52*d* along the lower edge of the inner peripheral surface thereof.

The assembly of the structure comprising the case band 51, synthetic resin gasket 53 and bezel 52 proceeds as follows. First, the synthetic resin gasket 53 is placed upon the stepped portion 51*a* of case band 51 in such a manner that the upper portion of the inner inclined surface 53*b* of the gasket 53 becomes into contact with the inclined surface 51'*c* defined by the upper surface of annular groove 51*c*. At this time a gap S is formed in the interior of the annular groove 51*c* between the gasket 53 and case band 51. The gap S prevents the synthetic resin gasket 53 from being pulled outward when the bezel 52 is press-fitted over the outside of the gasket 53. Next, the bezel 52 is disposed so as to engage its lower interior edge, namely the chamfered surface 52*d*, with the inclined outer guiding surface 53*a* of the gasket 53, as is shown in FIG. 16. Applying pressure to the bezel 52 while maintaining these conditions allows the bezel 52 to be guided downward along the inclined outer guiding surface 53*a* so that it approaches the stepped portion 51*a* while the synthetic resin gasket is urged into the annular groove 51*c*. Pressing the bezel 52 in this fashion causes the synthetic resin gasket 53 to expand into the annular groove 51*c* until the resin 53 gradually creeps into the gap S and fills the annular groove 51*c* owing to the plasticity of the resin. When the lower surface of the bezel 52 has reached the stepped portion 51*a* the synthetic resin gasket 53 is compressively sandwiched under maximum force by the upper surface 51'*c* of annular groove 51*c* and the inclined surface 52*c* of bezel 52 thereby to fixedly secure the bezel 52 by means of a counterforce resulting from compression. This condition is depicted in FIG. 17. It should be noted here that the chamfered surface 52*d* prevents the gasket 53 from being damaged during the press-fitting of the bezel 52.

In accordance with the structure mentioned above the synthetic resin gasket 53 sandwiched between the inclined surface 52*c* of bezel 52 and the inclined surface 51'*c* of case band 51 upon completing of the assembly serves to bias the bezel 52 and case band 51 in mutually opposing directions so that the bezel 52 is reliably held in place owing to the component of the force in parallel with the stepped portion 51*a*, which component acts upon the inclined surface 52*c* of the bezel 52. In addition, the inclined surfaces 52*c*, 51'*c* increase the area of contact between the synthetic resin gasket 53 and the bezel 52 and case band 51 on either side thereof, thereby enhancing watertightness. It is therefore possible with the structure of this type to reduce the depth h' of the stepped portion 51*a* to 0.8 mm and still maintain the fixing force and water-tight seal.

Figure 18:
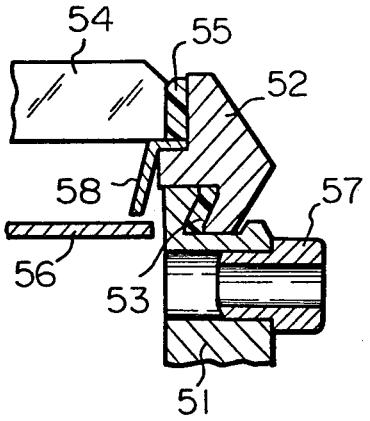
FIG. 18 is a cross sectional view of a modification of the watch case shown in FIGS. 16 and 17.
Figure 19:
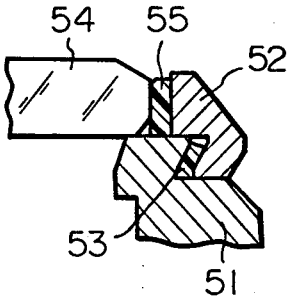
FIG. 19 is a cross sectional view of another modification of the watch case shown in FIGS. 16 and 17.

FIGS. 18 and 19 illustrate modifications of the structure shown in FIGS. 16 and 17, in which the structure for fixing the bezel 52 has been adapted for bezels of different shapes.

Illustrated in FIG. 18 is a structure adapted such that the portion at which the bezel 52 is mounted on the case band 51 is positioned between a dial 56 and watchglass 54. This structure will not interfere with a bore provided for a pipe 57 that accommodates an external operation member such as a time setting stem, and furnishes an arrangement suitable for the installation of a thin module. Since the mating surfaces of case band 51 and bezel 52 are within the field of view a masking plate 58 is provided to conceal the mating surfaces so that the attractive appearance of the timepiece will not be diminished. The masking plate 58 is separate from the bezel 52 and therefore can be colored and shaped as desired by means of machining, finishing and surface treatment.

The modification of FIG. 19 allows the bezel 52 to be reduced in thickness while at the same time facilitating the machining of the bezel 52. Specifically, the upper portion of bezel 52 is not provided with a step for seating the gasket 55 and watchglass 54, this function being performed by the upper surface of the case band 51.

Figure 20:
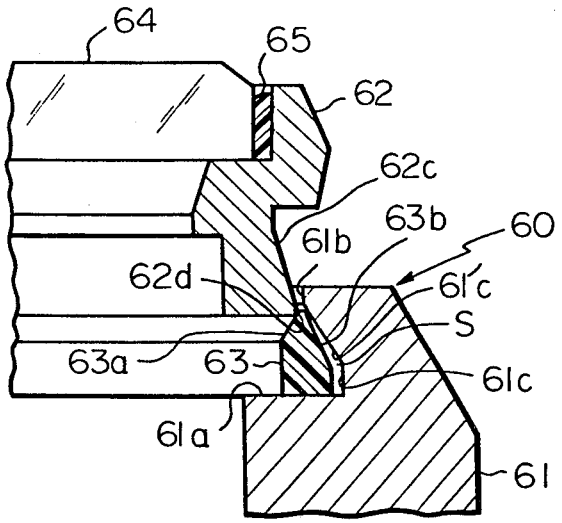
FIGS. 20 and 21 are cross sectional views of another modification of the watch case shown in FIGS. 16 and 17.
Figure 21:
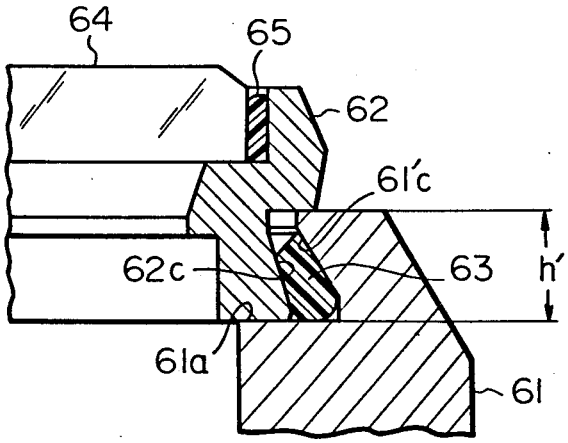

FIGS. 20 and 21 show another modification of the watch case shown in FIGS. 16 and 17. In this modification, the watch case comprises a watchglass 64 and a fixing member 60 composed of a bezel 62 and a case band 61. The inner wall **61*b* of case band 61 includes an annular groove 61*c* the upper surface of which defines an inclined surface 61'*c*, the lower surface of the annular groove 61*c* being formed in the same plane as a stepped portion 61*a*. A synthetic resin gasket 63 includes an inner peripheral surface the upper portion of which has an inclined inner guiding surface 63*a*, and an outer peripheral surface the upper portion of which has an inclined outer surface 63*b*. The outer periphery of that portion of bezel 62 that is to be fitted into case band 61 includes an inclined surface 62*c* approximately in parallel with the inclined surface 61'*c* defined by the upper surface of the annular groove 61*c*. The bezel 62 also has a chamfered surface 62*d*** along the lower edge of the outer peripheral surface thereof.

The assembly of the structure comprising the case band 61, synthetic resin gasket 63 and bezel 62 proceeds as follows. First, the synthetic resin gasket 63 is placed upon the stepped portion **61*a* of case band 61 in such a manner that the upper portion of the outer inclined surface 63*b* of the gasket 63 comes into contact with the inclined surface 61'*c* defined by the upper surface of annular groove 61*c*. At this time a gap S is formed in the interior of the annular groove 61*c* between the gasket 63 and case band 61. The gap S prevents the synthetic resin gasket 63 from being pulled inward when the bezel 62 is press-fitted into the gasket 63. Next, the bezel 62 is disposed so as to engage its lower exterior edge, namely the chamfered surface 62*d*, with the inclined inner guiding surface 63*a* of the gasket 63, as is shown in FIG. 20. Applying pressure to the bezel 62 while maintaining these conditions allows the bezel 62 to be guided downward along the inclined inner guiding surface 63*a* so that it approaches the stepped portion 61*a* while the synthetic resin gasket 63 is urged into the annular groove 61*c*. Pressing the bezel 62 in this fashion causes the synthetic resin gasket 63 to expand into the annular groove 61*c* until the resin gradually creeps into the gap S and fills the annular groove 61*c* owing to the plasticity of the resin. When the lower surface of the bezel 62 has reached the stepped portion 61*a* the synthetic resin gasket 63 is compressively sandwiched under maximum force by the upper surface 61'*c* of annular groove 61*c* and the inclined surface 62*c* of bezel 62 thereby to fixedly secure the bezel 62 by means of a counterforce resulting from compression. This condition is depicted in FIG. 21**.

Figure 22:
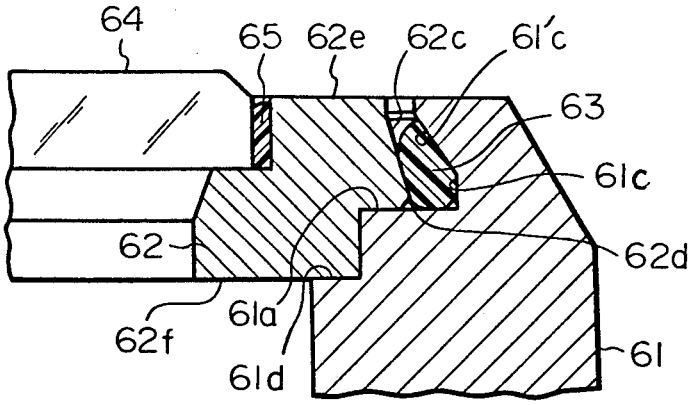
FIG. 22 is a cross sectional view of another modification of the watch case shown in FIGS. 16 and 17.

FIG. 22 illustrates a modification of the structure shown in FIG. 21, in which the structure for fixing the bezel has been adapted for a bezel of a different shape.

In the structure of FIG. 22 the outer peripheral surface of bezel 62 having a widened upper surface **62*e* includes an inclined surface 62*c* and a chamfered surface 62*d* which are identical to the corresponding components described above, and the upper portion of the inner peripheral surface of case band 61 includes an annular groove 61*c*, the upper inclined surface 61'*c* of which as well as the stepped portion 61*a* serve to compress the synthetic resin gasket 63 in cooperation with the inclined surface 62*c* to thereby fix the bezel 62. Since the bezel 62 does not have a portion which abuts the upper surface of the case band 61, in contradistinction to the arrangement of FIG. 21, the case band 61 is provided with an additional stepped portion 61*d* in order to strengthen the bezel retaining and supporting force. The abutting contact between the stepped portion 61*d* and a portion of the bottom surface 62*f* of the bezel 62** provides the additional supporting force.

Figure 23:
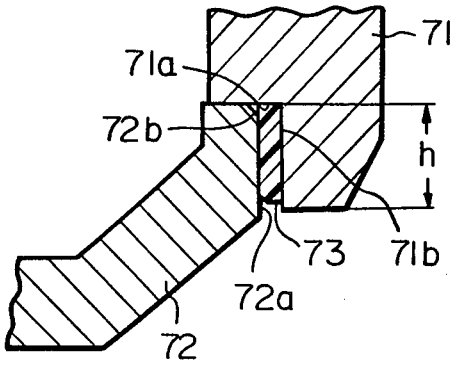
Fig. 23 PRIOR ART
FIG. 23 is a cross sectional view of another example of a watch case according to the prior art.

FIG. 23 shows another example of a watch case according to the prior art, in which the watch case is shown as comprising a case band 71, a back cover 72 and a synthetic resin gasket 73. More specifically, the lower part of the inner wall of case band 71 includes a stepped portion **71*a* for seating the synthetic resin gasket 73 and the back cover 72, the erect inner wall 71*b* of stepped portion 71*a* defining a substantially vertical surface. The upper edge of the outer peripheral surface of back cover 72 includes an outer wall 72*a* in parallel with the vertical wall 71*b* of the stepped portion, and an inclined guiding surface 72*b* is provided above the wall 72*a* to guide the back cover 72 into the synthetic resin gasket 73 when the former is press-fitted into the latter. The synthetic resin gasket 73 is placed on the stepped portion 71*a* of the case band 71 adjacent the wall 71*b* and, when the back cover 72 is fitted on the stepped portion 71*a*, is compressed from its inner and outer peripheral surfaces between the wall 71*b* of the case band 71 and the back cover 72, thereby fixedly securing the back cover 72 on the stepped portion 71*a* of the case band 71 owing to the frictional force resulting from the compressed synthetic resin gasket 73. With this structure the height of the synthetic resin gasket 73 must be at least 1.2 mm in order to maintain a reliable fixing force and watertight seal between the case band 71 and back cover 72; a height of less than 1.2 mm allows the watertight seal and fixing force to weaken so that it is difficult to commercialize the timepiece. It is therefore necessary in the conventional structure that the depth h of the vertical wall 71*b*, as shown in FIG. 23**, be a minimum of 1.2 mm.

However, as modern electronic movements now possess a thickness of between 3 and 4 mm, there is an increasing need to produce ever thinner and more compact watch cases as well. The prior-art construction has not been able to meet this need for the reasons described above.

Figure 24:
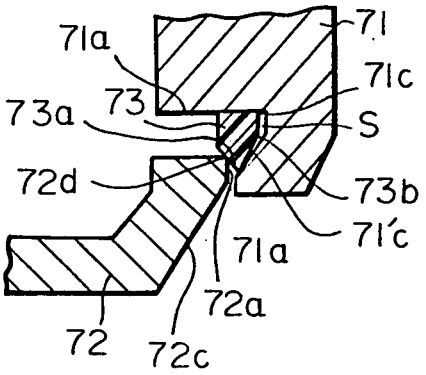
FIGS. 24 and 25 are correct sectional views of another preferred embodiment of a watch case according to the present invention.
Figure 25:
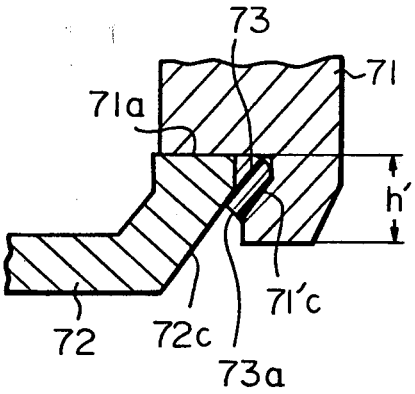

Another preferred embodiment to solve the above problems is shown in FIGS. 24 and 25, in which like or corresponding component parts are designated by the same reference numerals as those used in FIG. 23. Specifically, FIG. 24 is a cross-sectional view showing a back cover 72 prior to its being fixed to a case band 71, and FIG. 25 is a cross-sectional view showing the back cover 72 after it has been fixed to the case band 71.

In FIGS. 24 and 25, the inner wall **71*b* of case band 71 includes an annular groove 71*c* the lower surface of which defines an inclined surface 71'*c*, the upper surface of the annular groove 71*c* being formed in the same plane as a stepped portion 71***a*. A synthetic resin gasket 73 includes an inner peripheral surface the lower portion of which has an inclined inner guiding surface 73*a*, and an outer peripheral surface the lower portion of which has an inclined outer surface 73*b*. The outer periphery of that portion of back cover 72 that is to be fitted into case band 71 has a substantially vertical outer wall 72*a* and includes along the lower edge of the wall 72*a* an inclined surface 72*c* approximately in parallel with the inclined surface 71'*c* defined by the lower surface of the annular groove 71*c*. The back cover 72 also has a chamfered surface 72*d* along the upper edge of the outer peripheral surface thereof.

The assembly of the structure comprising the case band 71, synthetic resin gasket 73 and back cover 72 proceeds as follows. First, the synthetic resin gasket 73 is placed upon the stepped portion 71*a* of case band 71 in such a manner that the lower portion of the outer inclined surface 73*b* of the gasket 73 comes into contact with the inclined surface 71'*c* defined by the lower surface of annular groove 71*c*. At this time a gap S is formed in the interior of the annular groove between the gasket 73 and case band 71. The gap S prevents the synthetic resin gasket 73 from being pulled inward when the back cover 72 is press-fitted into the gasket 73. Next, the back cover 72 is disposed so as to engage its upper exterior edge, namely the chamfered surface 72*d*, with the inclined inner guiding surface 73*a* of the gasket 73, as is shown in FIG. 24. Applying pressure to the back cover 72 while maintaining these conditions allows the back cover 72 to be guided upward along the inclined inner guiding surface 73*a* so that it approaches the stepped portion 71*a* while the synthetic resin gasket 73 is urged into the annular groove 71*c*. Pressing the back cover 72 in this fashion causes the synthetic resin gasket 73 to expand into the annular groove 71*c* until the resin gradually creeps into the gap S and fills the annular groove 71*c* owing to the plasticity of the resin. When the upper surface of the back cover 72 has reached the stepped portion 71*a* the synthetic resin gasket 73 is compressively sandwiched under maximum force by the inclined surface 71'*c* of annular groove 71*c*, as well as the outer wall 72*a* and the inclined surface 72*c* of back cover 72 thereby to fixedly secure the back cover by means of a counterforce resulting from compression. This condition is depicted in FIG. 25.

In accordance with the embodiment mentioned above the synthetic resin gasket 73 sandwiched between the inclined surface 72*c* of back cover 72 and the inclined surface 71'*c* of case band 71 upon completion of the assembly serves to bias the back cover 72 and case band 71 in mutually opposing directions so that the back cover 72 is reliably held in place owing to the component of the force in parallel with the stepped portion 71*a*, which component acts upon the inclined surface 72*c* of the back cover 72. In addition, the inclined surfaces 72*c*, 71'*c* increase the area of contact between the synthetic resin gasket 73 and the back cover 72 and case band 71 on either side thereof, thereby enhancing watertightness. It is therefore possible with the structure of this type to reduce the depth h' of the stepped portion 71*a* to 0.6 mm and still maintain the fixing force and watertight seal.

Figure 26:
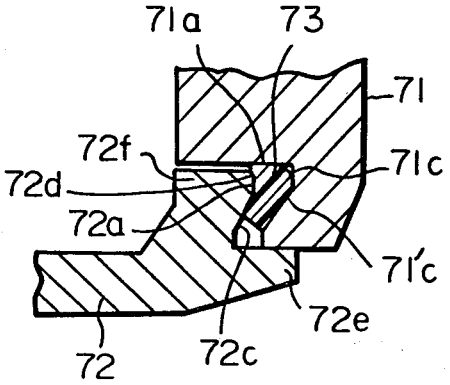
FIG. 26 is a cross sectional view of a modification of the watch case shown in FIGS. 24 and 25.

FIG. 26, illustrates a modification of the watch case shown in FIG. 25, in which the structure for fixing the back cover has been adapted for a back cover of a different shape.

In the structure of FIG. 26 the back cover 72 is provided with a flange 72*e* extending along the outer periphery thereof, and with an annular projection 72*f* located inwardly of the flange 72*e*, the outer peripheral surface of the annular projection 72*f* including a wall 72*a*, inclined surface 72*c* and a chamfered surface 72*d* which are identical to the corresponding components described above. The lower portion of the inner peripheral surface of case band 71 includes an annular groove 71*c* whose lower inclined surface 71'*c* as well as the stepped portion 71*a* serve to compress the synthetic resin gasket 73 in cooperation with the back cover 72 to thereby fix the same. The provision of the flange 72*e* allows the back cover 72 to be pried open. All other functions and effects are the same as those described above.

It will now be understood from the foregoing description that the principal concept of the present invention can be applied to any one of a combination of a watchglass member and a bezel member, a combination of the watchglass member and a case band member, a combination of the bezel member and the case band member, and a combination of the case band and a back cover member. More specifically, one of the watchglass member, bezel member, case band member and back member is formed at its peripheral surface with an inclined surface and a substantially vertical wall. An annular groove means is formed in another one of the watchglass member, bezel member, case band member and back member. The annular groove means includes an inclined surface. A synthetic resin gasket has an inclined guiding surface and an inclined engaging surface. The synthetic resin gasket is disposed in the annular groove means of said another one of said members and said one of said members is press fitted to the synthetic resin gasket. During this press fitting step, the vertical wall of said one of said members is guided by the inclined guiding surface of the synthetic resin gasket. The synthetic resin gasket is made to fill a space formed by the annular groove means and the vertical wall of said one of said members and at least a portion of the gasket is compressed between the inclined surface of said one of said members and the inclined surface of the annular groove means of said another one of said members to thereby fixedly retain said one of said members to said another one of said members by means of said gasket.

While the present invention has been shown and described with reference to particular embodiments by way of example, it should be noted that various other modifications and changes may be made without departing from the scope of the present invention.

What is claimed is:

1. A structure for fixing a watchglass of a watch case, comprising:

a watchglass fixing member having an inwardly facing annular groove which has its upper portion formed with an inclined surface and has its lower portion formed with an axial surface, a flange formed at an upper portion of said inclined surface and having an inner diameter, and a watchglass seating surface formed at a lower portion of said axial surface;

a watchglass having an outer diametric surface formed with a vertical wall with its height being lower than the height of said inclined surface at the upper portion of said annular groove while the outer diameter of the watchglass is slightly less than the inner diameter of said flange, an inclined guiding surface formed at a portion below said outer diametric surface and extending in the same direction as the inclined surface of said annular groove; and a synthetic resin gasket having an inner peripheral surface including an inclined guiding surface and a vertical inner wall below said inclined guiding surface, said vertical inner wall having an inner diameter less than the outer diameter of said vertical wall of said watchglass, said synthetic resin gasket also having an outer peripheral surface including an inclined engaging surface and a vertical outer wall below said inclined engaging surface, said vertical outer wall having its outer diameter less than the inner diameter of said annular groove to provide a gap therebetween;

said watchglass being press-fitted into said synthetic resin gasket by sliding along the inclined guiding surface of said synthetic resin gasket and being forced into a lower portion of said vertical inner wall of said gasket whereby said synthetic resin gasket is caused to expand outwardly into said gap to fill said annular groove and an upper portion of said synthetic resin gasket is compressed between the inclined surface of said watchglass and the inclined surface of said annular groove for thereby fixedly securing said watchglass in place while providing a waterproof condition.

2. A watch case structure according to claim 1, in which said watchglass fixing member comprises a bezel having a stepped portion formed at a lower portion of said annular groove, and in which said synthetic resin gasket is disposed on the stepped portion of said bezel.

3. A watch case structure according to claim 1, in which said watchglass fixing member comprises a bezel having a seating surface formed at a lower portion of said annular groove and a stepped portion formed below the seating surface of said bezel, and a bearing ring disposed on the stepped portion of said bezel to maintain a fixing force and a watertight seal.

4. A watch case structure according to claim 3, in which said bearing ring has a watchglass seating surface aligned with substantially the same plane as the seating surface of said bezel.

5. A watch case structure according to claim 3, in which said bearing ring has a watchglass seating surface located at a higher level than the seating surface of said bezel.

* * * * *